US009518761B2

(12) United States Patent
Rissler et al.

(10) Patent No.: US 9,518,761 B2
(45) Date of Patent: Dec. 13, 2016

(54) HEAT PUMP WATER HEATER APPLIANCE

(71) Applicant: General Electric Company, Schenectady, NY (US)

(72) Inventors: Christopher Bryan Rissler, La Grange, KY (US); Jonathan D. Nelson, Louisville, KY (US); Noel Gabriel Aguilar, Louisville, KY (US); Alan George Constance, Jeffersonville, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 176 days.

(21) Appl. No.: 14/495,261

(22) Filed: Sep. 24, 2014

(65) Prior Publication Data

US 2016/0084525 A1 Mar. 24, 2016

(51) Int. Cl.

| | |
|---|---|
| ***F24H 9/06*** | (2006.01) |
| ***F24H 4/04*** | (2006.01) |
| ***F25B 30/02*** | (2006.01) |

(52) U.S. Cl.
CPC *F24H 9/06* (2013.01); *F24H 4/04* (2013.01); *F25B 30/02* (2013.01)

(58) Field of Classification Search
CPC ..... F24H 4/04; F24H 9/06; F25B 30/02
See application file for complete search history.

(56) References Cited

U.S. PATENT DOCUMENTS

| | | | | | |
|---|---|---|---|---|---|
| 2,059,175 | A * | 10/1936 | Myracle | E21B 17/06 | 285/3 |
| 2,716,866 | A * | 9/1955 | Silva | F24H 4/04 | 122/26 |
| 2,935,279 | A * | 5/1960 | La Porte | F16M 7/00 | 248/632 |
| 4,173,872 | A * | 11/1979 | Amthor, Jr. | F24H 4/04 | 392/308 |
| 4,320,630 | A * | 3/1982 | Uselton | F25B 30/02 | 62/238.6 |
| 5,573,182 | A | 11/1996 | Gannaway et al. | | |
| 5,964,579 | A * | 10/1999 | Tang | F04B 39/0044 | 248/56 |
| 6,035,849 | A * | 3/2000 | Bluestone | F23L 13/02 | 126/285 R |
| 6,499,714 | B1 * | 12/2002 | Wike | F16B 5/0258 | 248/632 |
| 7,261,365 | B2 * | 8/2007 | Dickson | B60G 99/002 | 248/635 |

(Continued)

FOREIGN PATENT DOCUMENTS

| | | | | |
|---|---|---|---|---|
| CN | 202254325 | 5/2012 | | |
| CN | 202770059 | 3/2013 | | |
| DE | 4416487 | A1 * 11/1995 | | F16L 59/00 |

*Primary Examiner* — Steven B McAllister
*Assistant Examiner* — Steven Anderson, II
(74) *Attorney, Agent, or Firm* — Dority & Manning, P.A.

(57) ABSTRACT

The present subject matter provides a heat pump water heater appliance with a mounting assembly for coupling a compressor to a plate within a casing of the heat pump water heater appliance. The mounting assembly includes a post that extends through a foot of the compressor and a fastener that extends through the bracket and the plate into the post in order to secure the bracket and the post together. A nut is threaded onto the post in order to secure the post and the foot of the compressor together.

11 Claims, 6 Drawing Sheets

(56) References Cited

U.S. PATENT DOCUMENTS

| | | | | |
|---|---|---|---|---|
| 7,370,851 | B2 * | 5/2008 | Shin | B60R 7/06 267/137 |
| 2013/0043252 | A1 * | 2/2013 | Nelson | B21D 53/02 220/567.3 |
| 2014/0157814 | A1 * | 6/2014 | Duplessis | F24H 4/04 62/324.1 |

* cited by examiner

HEAT PUMP WATER HEATER APPLIANCE

FIELD OF THE INVENTION

The present subject matter relates generally to heat pump water heater appliances.

BACKGROUND OF THE INVENTION

Shipping heat pump water heater appliances poses certain challenges. In particular, heat pump water heater appliances may be damaged during transit by other objects impacting the heat pump water heater appliances or by falling over during transit. Damaged heat pump water heater appliances are expensive to repair or replace. In particular, sealed systems of heat pump water heaters can be expensive to repair or replace if the heat pump water heaters are dropped or struck. For example, components of the sealed systems, such as a compressor and/or an evaporator, may be positioned within a shroud at a top portion of the heat pump water heaters. When objects impact the water heater appliances or the water heater appliances fall over during transit, the compressor may detach or be torn from its mounting within the shroud.

Various shipping accessories are available to limit or prevent damage to heat pump water heater appliances during transit. Certain heat pump water heater appliances are shipped with a foam top panel that assists with protecting a top portion of the water heater appliances. However, such foam panels offer little support to the heat pump water heater's compressor.

Accordingly, a heat pump water heater appliance with features for securely mounting a compressor within the heat pump water heater appliance would be useful. In particular, a heat pump water heater appliance with features for hindering or preventing a compressor from detaching from the heat pump water heater appliance when the heat pump water heater appliance is dropped or tipped over would be useful.

BRIEF DESCRIPTION OF THE INVENTION

The present subject matter provides a heat pump water heater appliance with a mounting assembly for coupling a compressor to a plate within a casing of the heat pump water heater appliance. The mounting assembly includes a post that extends through a foot of the compressor and a fastener that extends through the bracket and the plate into the post in order to secure the bracket and the post together. A nut is threaded onto the post in order to secure the post and the foot of the compressor together. Additional aspects and advantages of the invention will be set forth in part in the following description, or may be apparent from the description, or may be learned through practice of the invention.

In a first exemplary embodiment, a heat pump water heater appliance is provided. The heat pump water heater appliance includes a casing and a tank disposed within the casing. The tank defines an interior volume. A sealed system is configured for heating water within the interior volume of the tank. The sealed system has a compressor disposed within the casing at a top portion of the casing. A plate is disposed within the casing at the top portion of the casing. The plate has a top surface and a bottom surface. A mounting assembly couples the compressor to the plate. The mounting assembly includes a bracket positioned on the bottom surface of the plate. A post is positioned at the top surface of the plate. The post extends through a foot of the compressor. A fastener extends through the bracket and the plate into the post in order to secure the bracket and the post together. A nut is threaded onto the post in order to secure the post and the foot of the compressor together.

In a second exemplary embodiment, a heat pump water heater appliance is provided. The heat pump water heater appliance includes a casing that extends between a top portion and a bottom portion. The casing has a shroud positioned at the top portion of the casing. A tank is disposed within the casing. The tank defines an interior volume. A sealed system is configured for heating water within the interior volume of the tank. The sealed system has a compressor disposed within shroud. A plate is positioned over the tank within the casing. The plate has a top surface and a bottom surface. A mounting assembly couples the compressor to the plate. The mounting assembly includes a bracket positioned on the bottom surface of the plate. A post extends through the bracket and the plate towards a foot of the compressor. A nut is threaded onto the post at the bracket. A fastener extends into the post at the foot of the compressor. The fastener is attached to the post in order to secure the foot of the compressor and the post together.

In a third exemplary embodiment, a heat pump water heater appliance is provided. The heat pump water heater appliance includes a casing that extends between a top portion and a bottom portion. The casing has a shroud positioned at the top portion of the casing. A tank is disposed within the casing. The tank defines an interior volume. A sealed system is configured for heating water within the interior volume of the tank. The sealed system has a compressor disposed within shroud. A plate is positioned over the tank within the casing. The heat pump water heater appliance also includes means for mounting the compressor of the sealed system to the plate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
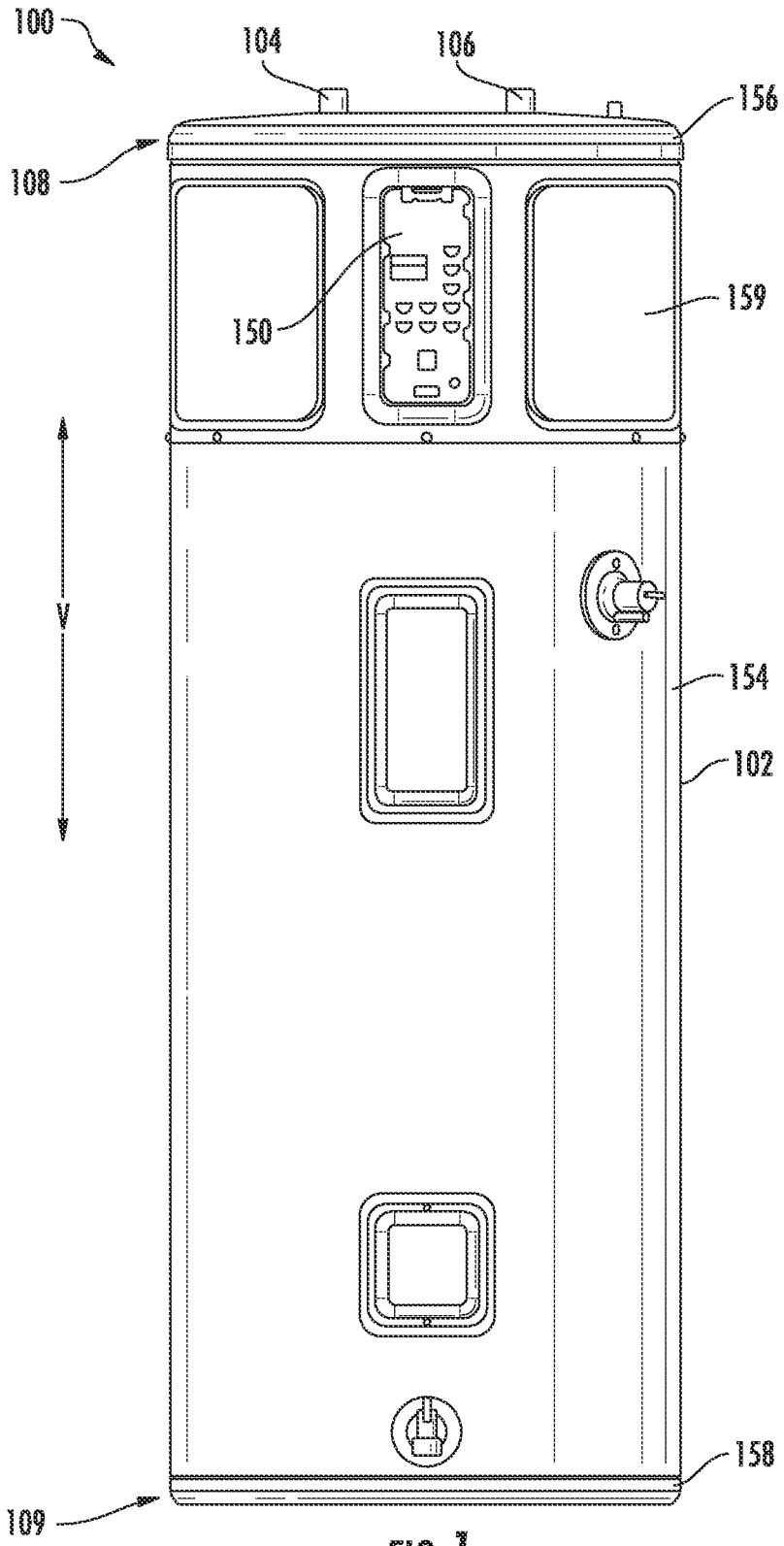
FIG. 1 provides a front elevation view of a water heater appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front elevation view of a water heater appliance 100 according to an exemplary embodiment of the present subject matter. Water heater appliance 100 includes an outer shell or casing 102. Casing 102 generally surrounds a tank 112 (FIG. 2) such that tank 112 is disposed within casing 102. Casing 102 may be formed from a variety of components. As illustrated, casing 102 may include a wrapper 154, one or more covers, such as a top cover 156 and a bottom cover 158, and a shroud 159 as illustrated. Covers 156, 158 may be fastened or coupled to wrapper 154 and shroud 159 to form casing 102.

Upper and lower heating elements 118, 119 (FIG. 2) and a sealed system 120 (FIG. 2) may also be positioned within casing 102 for heating water within tank 112. Upper and lower heating elements 118, 119 can be any suitable heating elements. For example, upper heating element 118 and/or lower heating element 119 may be an electric resistance element, a microwave element, an induction element, or any other suitable heating element or combination thereof. Lower heating element 119 may also be a gas burner. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water heater appliance 100 also includes an inlet or cold water conduit 104 and an outlet or hot water conduit 106 that are both in fluid communication with a chamber or interior volume 114 (FIG. 2) defined by tank 112. As an example, cold water from a water source, e.g., a municipal water supply or a well, can enter water heater appliance 100 through cold water conduit 104. From cold water conduit 104, such cold water can enter interior volume 114 of tank 112 wherein it is heated with heating elements 118, 119 and/or sealed system 120 to generate heated water. Such heated water can exit water heater appliance 100 at hot water conduit 106 and, e.g., be supplied to a bath, shower, sink, or any other suitable feature.

Water heater appliance 100 extends longitudinally between a top portion 108 and a bottom portion 109 along a vertical direction V. Thus, water heater appliance 100 is generally vertically oriented. Water heater appliance 100 can be leveled, e.g., such that casing 102 is plumb in the vertical direction V, in order to facilitate proper operation of water heater appliance 100. It should be understood that water heater appliance 100 is provided by way of example only and that the present subject matter may be used with any suitable water heater appliance, including for example a heat pump water heater appliance.

Figure 2:
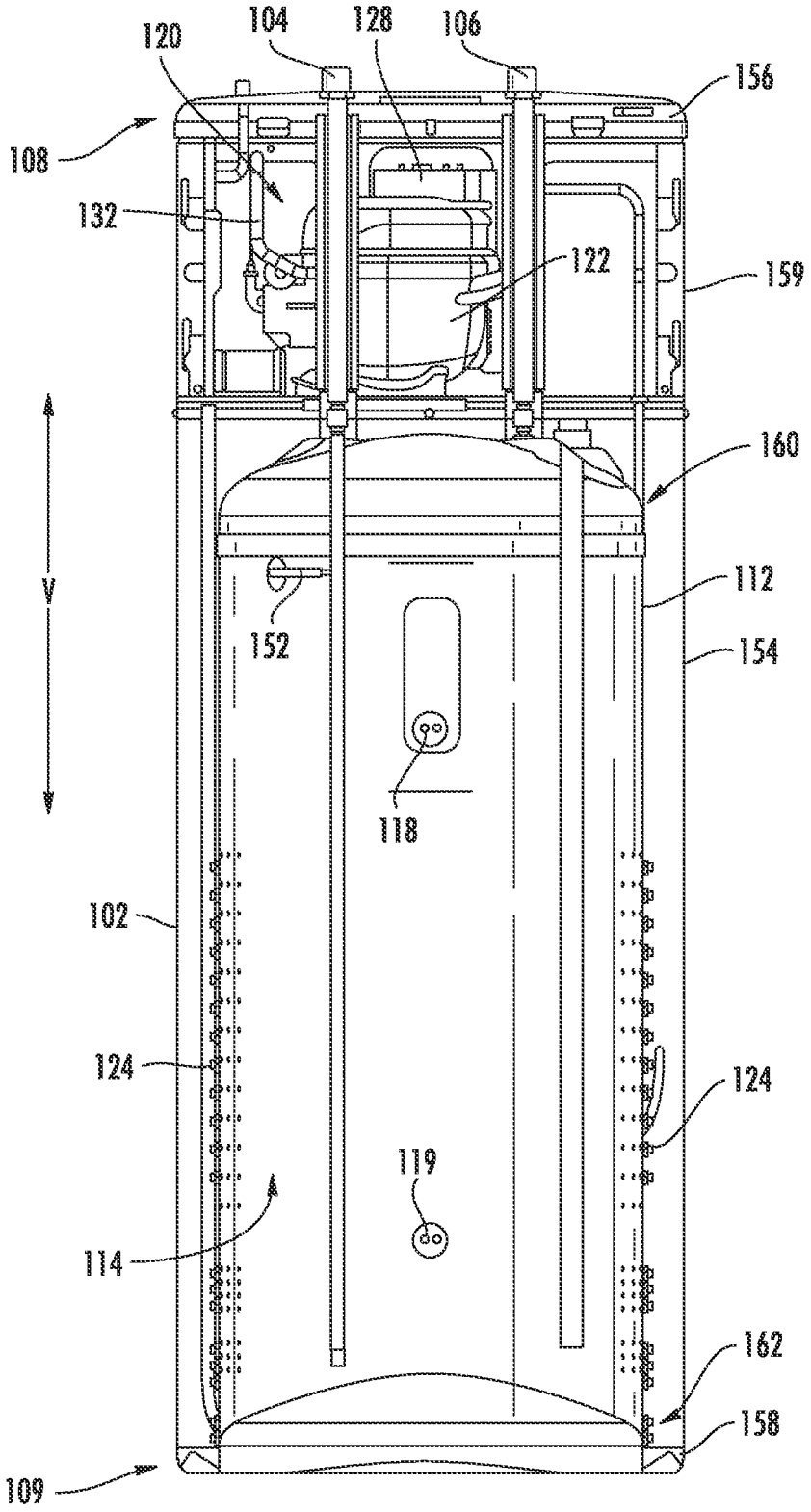
FIG. 2 provides a front section view of the exemplary water heater appliance of FIG. 1.

FIG. 2 provides a front section view of water heater appliance 100. As may be seen in FIG. 2, water heater appliance 100 includes sealed system 120 for heating water within interior volume 114 of tank 112. Sealed system 120 generally operates in a heat pump cycle. Thus, water heater appliance 100 is commonly referred to as a "heat pump water heater appliance." Water heater appliance 100 may additionally include one or more auxiliary heating elements, such as upper heating element 118 and/or lower heating element 119.

Sealed system 120 may include a compressor 122, a condenser 124 and an evaporator 128. Compressor 122 and/or evaporator 128 of sealed system 120 may be disposed within casing 102 at top portion 108 of water heater appliance 100, e.g., within shroud 159. As is generally understood, various conduits may be utilized to flow refrigerant between the various components of sealed system 120. Thus, e.g., evaporator 128 may be between and in fluid communication with condenser 124 and compressor 122. During operation of sealed system 120, refrigerant may flow from evaporator 128 through compressor 122. For example, refrigerant may exit evaporator 128 as a fluid in the form of a superheated vapor and/or high quality vapor mixture. Upon exiting evaporator 128, the refrigerant may enter compressor 122. Compressor 122 may be operable to compress the refrigerant. Accordingly, the pressure and temperature of the refrigerant may be increased in compressor 122 such that the refrigerant becomes a superheated vapor.

Condenser 124 may be assembled in a heat exchange relationship with tank 112 in order to heat water within interior volume 114 of tank 112 during operation of sealed system 120. In particular, condenser 124 may be positioned downstream of and in fluid communication with compressor 122, and may be operable to heat the water within interior volume 114 using energy from the refrigerant. For example, the superheated vapor from compressor 122 may enter condenser 124 wherein it transfers energy to the water within tank 112 and condenses into a saturated liquid and/or liquid vapor mixture.

Sealed system 120 may also include a throttling device 132 between condenser 124 and evaporator 128. Refrigerant, which may be in the form of high quality/saturated liquid vapor mixture, may exit condenser 124 and travel through throttling device 132 before flowing through evaporator 128. Throttling device 132 may generally expand the refrigerant, lowering the pressure and temperature thereof. The refrigerant may then be flowed through evaporator 128.

Throttling device 132 may be any suitable components for generally expanding the refrigerant. For example, in some exemplary embodiments, throttling device 132 may be a Joule-Thomson expansion valve, also known as a "J-T valve." In other exemplary embodiments, throttling device 132 may be an ejector. In still other exemplary embodiments, a capillary tube, fixed orifice, or other suitable apparatus may be utilized as throttling device 132.

Water heater appliance 100 may additionally include a temperature sensor 152. Temperature sensor 152 may be configured for measuring a temperature of water within interior volume 114 of tank 112. Temperature sensor 152 can be positioned at any suitable location within water heater appliance 100. For example, temperature sensor 152 may be positioned within interior volume 114 of tank 112 or may be mounted to tank 112 outside of interior volume 114 of tank 112. Temperature sensor 152 may further be positioned within upper portion 160 or lower portion 162. When mounted to tank 112 outside of interior volume 114 of tank 112, temperature sensor 152 can be configured for indirectly measuring the temperature of water within interior volume 114 of tank 112. For example, temperature sensor 152 can measure the temperature of tank 112 and correlate the temperature of tank 112 to the temperature of water within interior volume 114 of tank 112. Temperature sensor 152 may be any suitable temperature sensor. For example, temperature sensor 152 may be a thermocouple or a thermistor.

Water heater appliance 100 may further include a controller 150 that regulates operation of water heater appliance 100. Controller 150 may be, for example, in operative communication with sealed system 120 (such as compressor 122, and/or other components thereof), auxiliary heating elements, and/or temperature sensor 152. Thus, controller 150 can selectively activate system 120 and/or auxiliary heating elements in order to heat water within interior volume 114 of tank 112.

Controller 150 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 3:
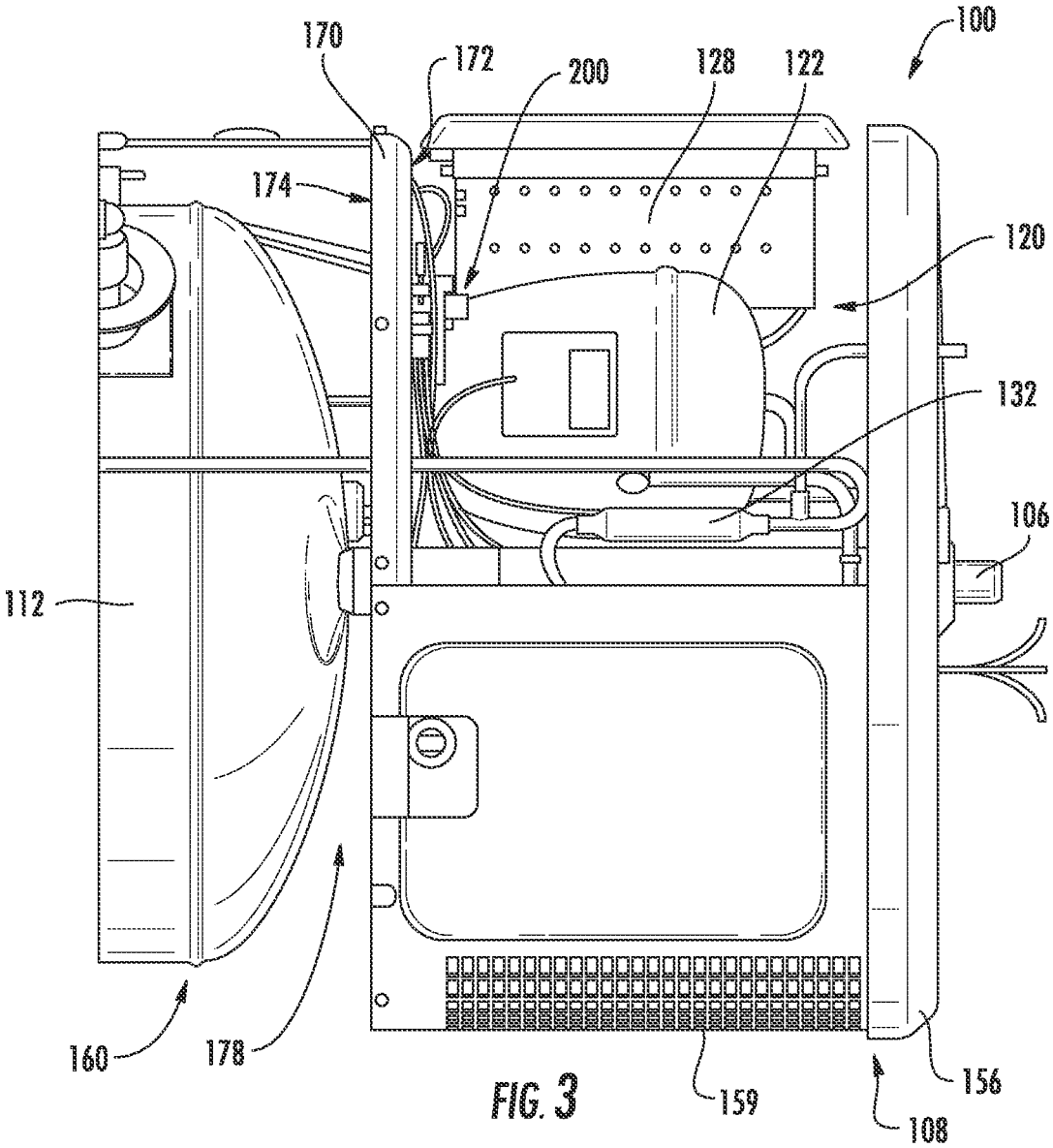
FIG. 3 provides a partial plan view of certain components of the exemplary water heater appliance of FIG. 1 with the exemplary water heater appliance shown in a laid down position.
Figure 4:
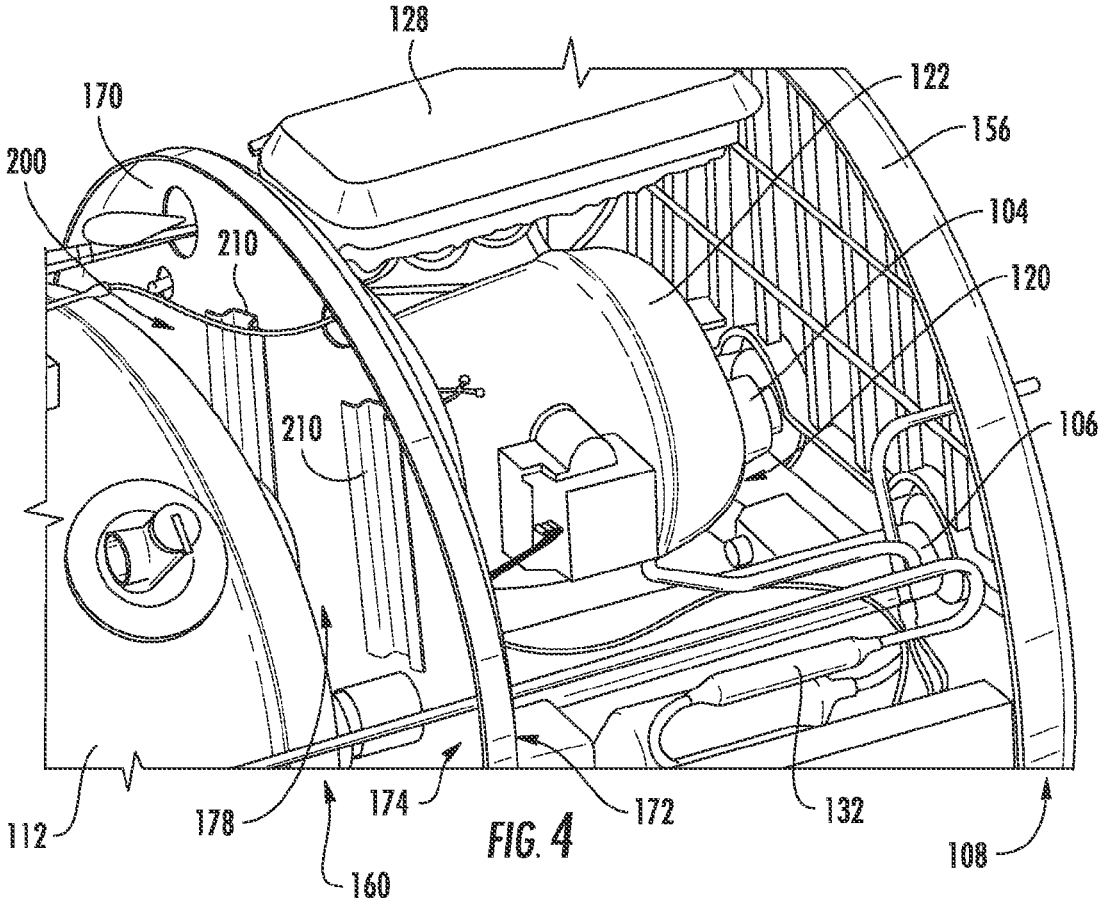
FIG. 4 provides a partial perspective view of certain components of the exemplary water heater appliance of FIG. 1 with the exemplary water heater appliance shown in the laid down position.

FIG. 3 provides a partial plan view of water heater appliance 100. FIG. 4 provides a partial perspective view of water heater appliance 100. In FIGS. 3 and 4, water heater appliance 100 is shown in a horizontal or laid down position. Conversely, in FIGS. 1 and 2, water heater appliance 100 is shown in a vertical or upright position. Water heater appliance 100 may fall or tip over from the upright position to the laid down position during transit of water heater appliance 100. When water heater appliance 100 falls to the laid down position, components of water heater appliance 100 may be damaged or break off. For example, compressor 122 may be subjected to large forces that urge compressor 122 to break free of water heater appliance 100 when water heater appliance 100 falls from the upright position to the laid down position during transit of water heater appliance 100. However, water heater appliance 100 includes features for securely mounting compressor 122 within water heater appliance 100 and hindering or preventing compressor 122 from breaking off water heater appliance 100 when water heater appliance 100 falls to the laid down position. Such features are discussed in greater detail below.

As may be seen in FIGS. 3 and 4, water heater appliance 100 includes a plate 170. Plate 170 is disposed within casing 102, e.g., within or adjacent shroud 159 of casing 102 at top portion 108 of water heater appliance 100. Plate 170 may be mounted or fastened to casing 102. For example, plate 170 may be mounted to wrapper 154 and/or shroud 159 of casing 102 with screws or adhesive. Plate 170 may also be fastened or coupled to at least one of cold water conduit 104 and hot water conduit 106. Thus, plate 170 may be fixed within water heater appliance 100 to at least one of casing 102, cold water conduit 104 and hot water conduit 106. Plate 170 has a top surface 172 and a bottom surface 174.

Water heater appliance 100 also includes a mounting assembly 200. Mounting assembly 200 couple or connects compressor 122 to plate 170. Mounting assembly 200 is discussed in greater detail below. While not shown in FIGS. 3 and 4, foam insulation may be disposed within casing 102 in order to assist with insulating tank 112. The foam insulation may extend between casing 102 and tank 112. In addition, plate 170 and tank 112 may define an insulated volume 178 therebetween within casing 102. The foam insulation may be disposed within, e.g., and fill, insulated volume 178. The foam insulation within insulated volume 178 may also assist with supporting compressor 122 on plate 170 as discussed in greater detail below.

Figure 5:
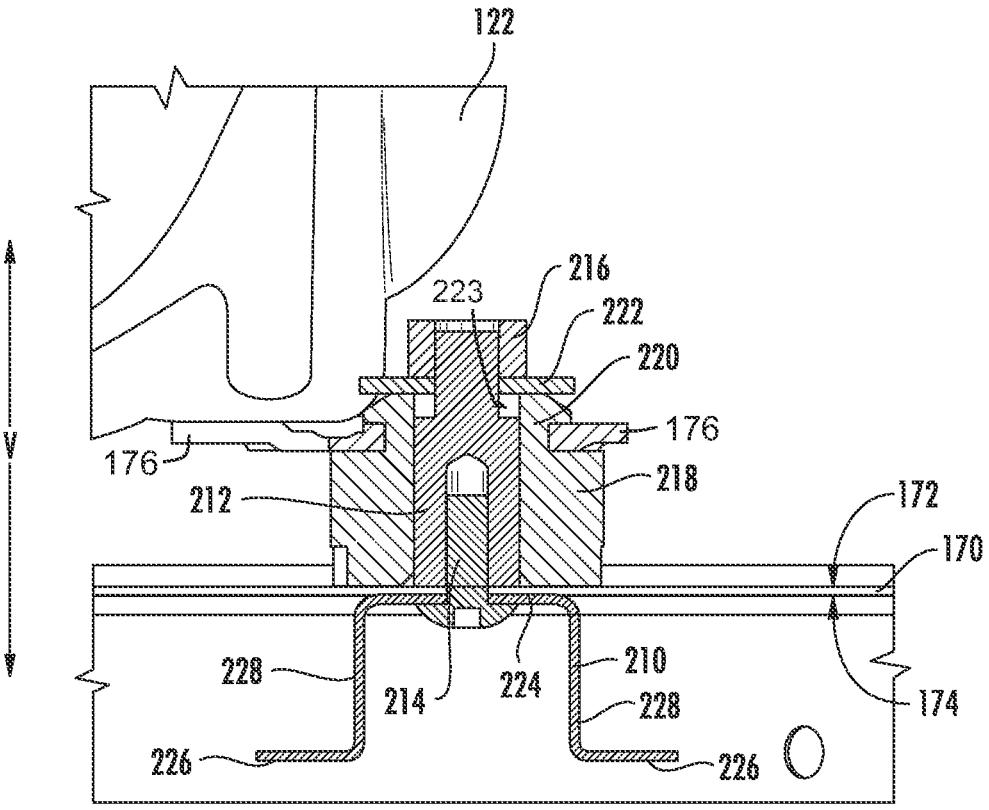
FIG. 5 provides a section view of a mounting assembly according to an exemplary embodiment of the present subject matter mounting a compressor to a plate within the exemplary water heater appliance of FIG. 1.

FIG. 5 provides a section view of mounting assembly 200 according to an exemplary embodiment of the present subject matter. As discussed above, mounting assembly 200 assists with mounting compressor 122 to plate 170. As may be seen in FIG. 5, mounting assembly 200 includes a bracket 210. Bracket 210 is positioned on bottom surface 174 of plate 170. In addition, bracket 210 may be positioned within insulated volume 178. Thus, bracket 210 may be at least partially encased within foam insulation in insulated volume 178. The foam insulation within insulated volume 178 may support bracket 210 and hinder or limit movement of bracket 210. In such a manner, motion of compressor 122 may be similarly limited or hindered.

Mounting assembly 200 also includes a post 212. Post 212 is positioned at top surface 172 of plate 170. Post 212 extends, e.g., from top surface 172 of plate 170, through a foot 176 of compressor 122. It should be understood that while only one foot 176 of compressor 122 is illustrated in FIG. 5, compressor 122 may include multiple feet in certain exemplary embodiments. Separate mounting assemblies, such as mounting assembly 200 with or without common brackets 210, may be used to secure each foot of compressor 122 to plate 170.

Mounting assembly 200 also includes a fastener 214 and a nut 216 that assist with coupling foot 176 of compressor 122 to plate 170 via or with post 212. Fastener 214 extends through bracket 210 and plate 170 into post 212. Thus, a head of fastener 214 may be positioned on or at bracket 210 and below foot 176 of compressor 122. By extending into post 212, fastener 214 assists with securing or coupling bracket 210 and post 212 together. Nut 216 is threaded onto post 212, e.g., at or above foot 176 of compressor 122. Thus, nut 216 assists with securing or coupling post 212 and foot 176 of compressor 122 together. In such a manner, fastener 214 and nut 216 may be coupled or secured to post 212 in order to assist with coupling foot 176 of compressor 122 to plate 170.

Fastener 214 may be any suitable type of fastener. For example, fastener 214 may be a screw, a bolt, a stake, a rivet, etc. In certain exemplary embodiments, fastener 214 may be threaded to post 212. Thus, fastener 214 and nut 216 may engage threads of post 212.

Mounting assembly 200 further includes a grommet 218. Grommet 218 may be constructed with an elastic material, such as rubber or an elastic polymer. Grommet 218 may assist with limiting or hindering force transfer between compressor 122 and plate 170 in order to assist compressor 122 with operating quietly. In particular, grommet 218 may permit compressor 122 to move relative to plate 170 during operation of compressor 122 despite mounting assembly 200 coupling compressor 122 to plate 170.

As may be seen in FIG. 5, grommet 218 is disposed or positioned on post 212. In particular, grommet 218 may be positioned between plate 170 and foot 176 of compressor 122 on post 212. As an example, grommet 218 may extend between plate 170 and foot 176 of compressor 122 on post 212. Grommet 218 extends about or encases at least a portion of post 212. A leg 220 of grommet 218 extends through foot 176 of compressor 122. Thus, leg 220 of grommet 218 may be positioned between foot 176 of compressor 122 and post 212. Mounting assembly 200 may also include a washer 222 positioned on post 212. Washer 222 may extend between nut 216 and leg 220 of grommet 218, as shown in FIG. 5.

A length of post 212 may be selected such that washer 222 compresses grommet 218, e.g., leg 220 of grommet 218, a specified or predetermined amount when nut 216 is threaded onto post 212 and compressed against washer 222. The length of post 212 may restrict movement of compressor 122 while preserving noise dampening of grommet 218 during operation of compressor 122. In particular, the length of post 212 may be selected such that a gap 223 is provided between washer 222 and a cylinder of post 212 within leg 220 of grommet 218. Properly sizing gap 223 may suitably restrict movement of compressor 122 while preserving noise dampening of grommet 218 during operation of compressor 122.

Figure 6:
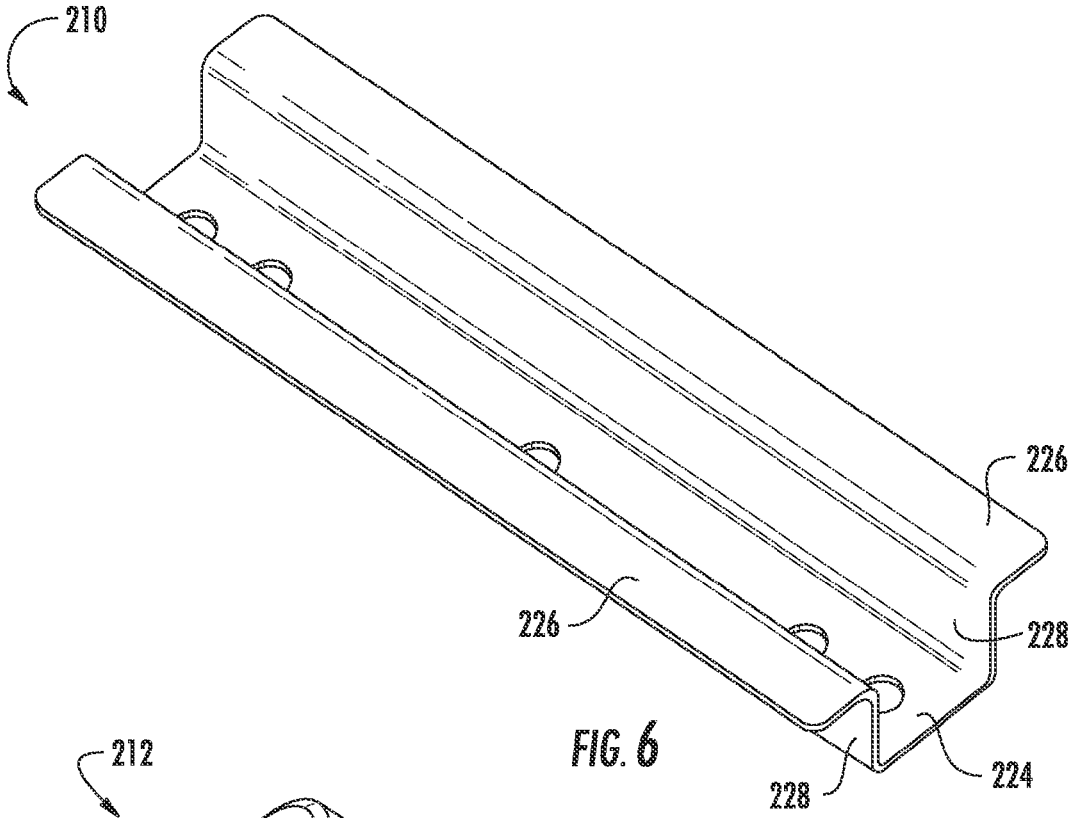
FIG. 6 provides a perspective view of a bracket of the exemplary mounting assembly of FIG. 5.

FIG. 6 provides a perspective view of bracket 210. As may be seen in FIG. 6, bracket 210 includes a base plate 224, a pair of support plates 226 and a pair of connection plates 228. Base plate 224 may be positioned on or at bottom surface 174 of plate 170. Support plates 226 are spaced apart from base plate 224. Thus, support plates 226 may be disposed or positioned within insulated volume 178 and be spaced apart from bottom surface 174 of plate 170, e.g., and parallel with base plate 224. Support plates 226 are also spaced apart from each other. Thus, support plates 226 may be positioned at opposite sides of base plate 224, as shown in FIG. 6. Support plates 226 may also be positioned coplanar or parallel with each other. Each connection plate of connection plates 228 extends between and connects a respective one of support plates 226 to base plate 224. Thus, connection plates 228 are spaced apart from each other and may be positioned at opposite sides of base plate 224, as shown in FIG. 6. Connection plates 228 may act as I-beams between support plates 226 to base plate 224.

Support plates 226 and connection plates 228 may be encased within or surrounded by foam insulation within insulated volume 178. The foam insulation may brace or hold support plates 226 and connection plates 228 within insulated volume 178. Thus, the foam insulation may hinder or limit movement of bracket 210. In such a manner, the foam insulation may assist with hinder or limit movement of compressor 122 and with mounting compressor 122 on plate 170, and the foam insulation may also assist with preventing compressor 122 from tearing free of plate 170 when water heater appliance 100 falls to the laid down position. As may be seen in FIG. 6, a length of bracket 210 may be selected such that bracket 210 extends past posts 212, holes (not labeled) for posts 212 are shown in FIG. 6, when bracket 210 is mounted to plate 170. In such a manner, impact forces may be distributed over a larger area beneath plate 170.

Bracket 210 may be formed or with any suitable material. For example, bracket 210 may be formed with a single continuous sheet of metal, such as steel. Thus, the single continuous sheet of metal may be folded or otherwise shaped to form base plate 224, support plates 226 and connection plates 228 of bracket 210. The single continuous sheet of metal may have any suitable thickness or gauge. For example, the single continuous sheet of metal may have a thickness greater than three hundredths of an inch. In alternative exemplary embodiments, base plate 224, support plates 226 and connection plates 228 of bracket 210 may be separate pieces of metal connected, e.g., welded, to each other to form bracket 210.

Figure 7:
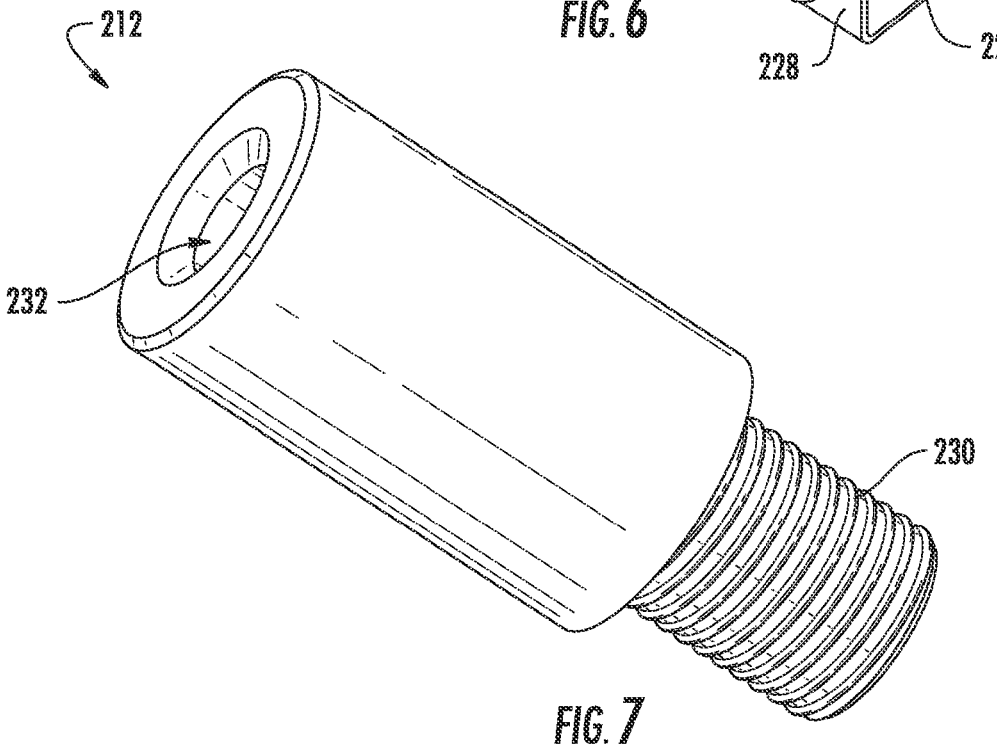
FIG. 7 provides a perspective view of a post of the exemplary mounting assembly of FIG. 5.

FIG. 7 provides a perspective view of post 212. As may be seen in FIG. 7, post 212 includes a threaded portion 230 and a threaded chamber 232. Nut 216 may be threaded onto post 212 at threaded portion 230 of post 212. Fastener 214 may be threaded into post 212 at threaded chamber 232 of post 212.

It should be understood that the particular arrangement and configuration of mounting assembly 200 shown in FIG. 5 is provided by way of example and that mounting assembly 200 may be provided in various alternative arrangements and configurations in alternative exemplary embodiments. For example, post 212 may extend through bracket 210 and plate 170 towards foot 176 of compressor 122, and nut 216 may be threaded onto post 212 at bracket 210. In addition, fastener 214 may extend into post 212 at foot 176 of compressor 122. Thus, the position of nut 216 and fastener 214 may be flipped or inverted. In addition two nuts 216 or two fasteners 214 may be used to rather than the combination of nut 216 and fastener 214 shown in FIG. 5.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance, comprising:

a casing;

a tank disposed within the casing, the tank defining an interior volume;

a sealed system configured for heating water within the interior volume of the tank, the sealed system having a compressor disposed within the casing at a top portion of the casing;

a plate disposed within the casing at the top portion of the casing, the plate having a top surface and a bottom surface; and a mounting assembly coupling the compressor to the plate, the mounting assembly comprising a bracket positioned on the bottom surface of the plate;

a post positioned at the top surface of the plate, the post extending through a foot of the compressor;

a grommet extending about the post, the grommet positioned between the plate and the foot of the compressor on the post, a leg of the grommet extending through the foot of the compressor such that the leg of the grommet is positioned between the foot of the compressor and the post;

a fastener extending through the bracket and the plate into the post in order to secure the bracket and the post together; and a nut threaded onto the post at a threaded portion of the post in order to secure the post and the foot of the compressor together;

a washer positioned on the threaded portion of the post, the washer extending between the nut and the leg of the grommet, the nut compressing the leg of the grommet between the nut and the foot of the compressor, the washer and a cylinder portion of the post spaced apart by a gap within the leg of the grommet.

2. The heat pump water heater appliance of claim 1, wherein the bracket comprises:

a base plate positioned on the bottom surface of the plate;

a pair of support plates spaced apart from the bottom surface of the plate and positioned at opposite sides of the base plate; and a pair of connection plates, each connection plate of the pair of connection plates extending between and connecting a respective one of the pair of support plates and the base plate.

3. The heat pump water heater appliance of claim 2, wherein the bracket is formed with a single continuous sheet of metal.

4. The heat pump water heater appliance of claim 3, wherein the single continuous sheet of metal has a thickness greater than three hundredths of an inch.

5. The heat pump water heater appliance of claim 2, wherein the support plates of the pair of support plates are positioned coplanar with each other.

6. The heat pump water heater appliance of claim 1, further comprising foam insulation, the plate and the tank defining an insulated volume therebetween, the foam insulation disposed within the insulated volume, the bracket at least partially encased within the foam insulation.

7. The heat pump water heater appliance of claim 1, wherein the fastener is threaded to the post.

8. A heat pump water heater appliance, comprising:

a casing extending between a top portion and a bottom portion, the easing having a shroud positioned at the top portion of the casing;

a tank disposed within the casing, the tank defining an interior volume;

a sealed system configured for heating water within the interior volume of the tank, the sealed system having a compressor disposed within shroud;

a plate positioned over the tank within the casing, the plate having a top surface and a bottom surface; and a mounting assembly coupling the compressor to the plate, the mounting assembly comprising a bracket positioned on the bottom surface of the plate, the bracket comprising a base plate, a pair of support plates and a pair of connection plates, the base plate positioned on the bottom surface of the plate, the pair of support plates spaced apart from the bottom surface of the plate and positioned at opposite sides of the base plate, each connection plate of the pair of connection plates extending between and connecting a respective one of the pair of support plates and the base plate;

a post extending through the bracket and the plate towards a foot of the compressor;

a grommet disposed on the post, the grommet positioned between the plate and the foot of the compressor on the post, a leg of the grommet extending through the foot of the compressor such that the leg of the grommet is positioned between the foot of the compressor and the post;

a nut threaded onto the post at the bracket;

a fastener extending into the post at the foot of the compressor, the fastener attached to the post in order to secure the foot of the compressor and the post together.

9. The heat pump water heater appliance of claim 8, wherein the bracket is formed from a single continuous sheet of metal.

10. The heat pump water heater appliance of claim 9, wherein the single continuous sheet of metal has a thickness greater than three hundredths of an inch.

11. The heat pump water heater appliance of claim 8, further comprising foam insulation disposed within an insulated volume defined between the plate and the tank, the bracket at least partially encased within the foam insulation.

* * * * *